United States Patent [19]

Busch

[11] 4,304,364

[45] Dec. 8, 1981

[54] WINDING UNIT

[75] Inventor: Hans-Jochen Busch, Remscheid, Fed. Rep. of Germany

[73] Assignee: Barmag Barmer Maschinenfabrik AG, Remscheid, Fed. Rep. of Germany

[21] Appl. No.: 124,611

[22] Filed: Feb. 25, 1980

[30] Foreign Application Priority Data

Feb. 26, 1979 [DE] Fed. Rep. of Germany ..... 2907499

[51] Int. Cl.[3] ..... B65H 54/42

[52] U.S. Cl. ..... 242/18 DD; 242/35.5 R; 242/41

[58] Field of Search ..... 242/18 DD, 18 R, 18 A, 242/18 B, 65, 66, 35.5 R, 41

[56] References Cited

U.S. PATENT DOCUMENTS

| | | | |
|---|---|---|---|
| 3,355,116 | 11/1967 | Conrad | 242/18 DD |
| 3,575,357 | 4/1971 | Enneking | 242/18 DD |
| 3,807,647 | 4/1974 | Miller | 242/18 DD |
| 3,841,574 | 10/1974 | Lenk | 242/18 DD |
| 3,977,615 | 8/1976 | Owens et al. | 242/18 DD X |
| 4,009,839 | 3/1977 | Bense | 242/18 DD |
| 4,106,710 | 8/1978 | Schippers et al. | 242/18 DD X |

FOREIGN PATENT DOCUMENTS

| | | | |
|---|---|---|---|
| 744067 | 6/1970 | Belgium | 242/18 DD |
| 818546 | 8/1959 | United Kingdom | 242/18 DD |

*Primary Examiner*—Stanley N. Gilreath
*Attorney, Agent, or Firm*—John H. Shurtleff

[57] ABSTRACT

A winding unit for a spinning machine having a cantilevered chuck adapted to removably hold a plurality of spools on which threads are wound with a traversing movement in a thread running plane. A slide carriage is used to carry traversing means and a contact roller with their axes of rotation parallel to each other and to the chuck axis, traversing thread guides projecting on one side of the carriage into the thread running plane and a plurality of carriage guide members being arranged in a guide plane on the opposite side of the carriage. Counterbalancing means are also provided to counteract part or all of the weight of the slide carriage, and retractable holding means are preferably mounted to support the front end of the cantilevered chuck.

20 Claims, 5 Drawing Figures

WINDING UNIT

BACKGROUND OF THE INVENTION

In the winding of synthetic fiber threads in spinning installations, one strives to spin as large a number of threads as possible over a given machine length. For this reason, it is common to arrange individual winding units, i.e. individual thread winding devices, in decks one over another, so that in one division or spacing for each winding position in the longitudinal direction of the machine, several threads can be wound. In this arrangement of winding units, it is also a known practice to support the chucks, i.e. the spool holders for the reception and clamping of sleeves on which the threads are wound, in such a way that they project with the free end of the chuck spindle cantilevered away from the machine face. Thereby, one can wind several spools on each cantilevered chuck spindle in order to spin and wind a plurality of threads in each division of the machine.

This manner of utilizing one division or spaced position for spinning several threads has been limited by the technically feasible length of the cantilevered chucks, the traversing mechanisms and, if used, the contact roller for controlling the peripheral velocity of the spools. A carrying unit, e.g. a slide carriage, serves as a means of movably bearing each traversing mechansim and any contact or drive roller in a single assembly and this carriage must also be limited in length and overall size. Consequently, the number of threads to be produced and wound in a spinning machine is limited on the one hand by the fact that the number of divisions or winding positions cannot be reduced beyond a certain extent, but on the other hand the total number of threads is also limited by the fact that it is impossible to exceed a certain cantilevered length of the chuck for removably mounting sleeves and winding individual thread spools thereon.

SUMMARY OF THE INVENTION

It is a primary object of the present invention to overcome these restrictions or limitations on the number of winding units and threads capable of being wound on a spinning machine of given length. Another object of the invention is to provide a retractable support for the cantilevered end of the chuck of each winding unit. Still another object of the invention is to provide a better arrangement of winding units having a high capacity for a number of thread winding positions but still permitting good access and easy loading of sleeves and removal of wound spools. These and other objects and advantages will be more apparent upon consideration of the following disclosure.

In accordance with the invention, a winding unit having a generally known combination of elements, including a slide carriage carrying a thread traversing device and, if needed, a contact roller in rolling contact with the circumference of the sleeve or spool, is improved by providing guide members bearing the slide carriage on its side which is turned away from or opposite to the thread running plane, i.e. that plane formed by the threads being taken up with a traversing movement, said guide members being mounted outside of the largest radius of the wound spools. It is particularly desirable in the novel winding unit of the present invention to also provide counterbalancing means acting on the slide carriage so as to partly or completely compensate for the weight of the entire carriage assembly.

The thread running plane is determined by the fact that the threads running into each winding unit are conducted first through fixed thread guides which are seated substantially perpendicularly above the traversing thread guides of the winding unit. These traversing thread guides are mounted to project outwardly from one side of the slide carriage and run on a conventional reverse threaded roller to reciprocate on a line parallel to the chuck and spool, so that each thread in its running path between the fixed thread guide and the traversing thread guide describes a so-called traverse triangle, and it is this triangle or group of triangles which define the thread running plane, usually a vertical or almost vertical plane.

The guide plane in which the carriage guide members lie is preferably aligned parallel to the thread running plane but may also form an angle up to about 10° with this thread running plane.

In the improved construction and arrangement of winding units according to the present invention, there must be a slightly larger division or spacing of the winding units along the length of the spinning machine as compared to earlier machines. However, this reduction in the number of winding units per unit length of the machine is more than made up for by a decisive increase in the cantilevered chuck length available for winding a plurality of threads.

The counterbalancing means, by which the pressure or loading of the slide carriage weight is wholly or partially relieved, is preferably arranged in the guide plane, i.e. the same plane as the carriage guide members along which the carriage moves, and is also preferably arranged in substantially that normal plane (perpendicular to the guide plane) containing the center of gravity of the slide carriage. The counterbalancing means is conveniently combined with one of the guide means, e.g. as a piston-cylinder unit actuated by pneumatic or hydraulic pressure or as a threaded post or shaft having its own drive motor. The weight of the slide carriage carrying the traversing guides and any contact or guide roller is at least partly alleviated so as to control the contact pressure placed on each spool as it is wound as well as maintaining the position of the traversing thread guides with reference to the spools.

The invention has a further advantage in that the axial depth of each winding unit can also be reduced in many applications of the invention whereas prior devices could not offer this flexibility in construction due to the adverse positions of the bearing supports, guide means and the drive of the slide carriage. The improved capability of constructing a two-sided spinning machine is thus offered by the present invention, whereby the individual winding units can be arranged on both sides of the longitudinal middle plane of the machine with the chucks or chucking spindles cantilevered outwardly from this middle plane. This back to back arrangement is conveniently serviced with good access from either side of the entire machine.

The carriage guides as well as the preferred counterbalancing means are preferably arranged along a perpendicularly projecting longitudinal member or segment of the machine housing, said longitudinal member projecting perpendicularly from the machine face and including or lying close beside the guide plane. This longitudinal member together with a base member (perpendicular to both the longitudinal member and the machine face) act as a side stand and can serve to accommodate other important parts of the winding unit. This longitudinal portion of the housing can carry, for example, an ejector means with a so-called push-out arm, especially so as to better accommodate the construction depth of each winding unit. This ejector essentially includes a displaceable push-out arm slidable along a rail, shaft, guide slot or the like in positions axially parallel to the chuck axis. The push-out arm engages behind the first spool and sleeve on the machine side and pushes this spool or the plurality of spools axially forwardly off the free end of the chuck. The actuating means for this push-out arm is preferably a pneumatic piston-cylinder unit or a threaded spindle arrangement or else a rope-pulley run by another simple piston-cylinder unit. The ejector is most conveniently arranged with its longitudinal axis beside the chuck and parallel thereto, i.e. as seen in the axial direction of these two parts.

The minimum distance between the side wall or longitudinal housing member and the chuck axis is sufficiently great to provide adequate space for the growing spool.

The longitudinal housing member or side stand can be advantageously made sound-proof, e.g. using a suitable sound absorbing material in its construction, e.g. a foamed covering material, in order to reduce noise and its annoying effect on personnel working at adjacent winding units.

According to the invention, it has become possible to provide chucks with a cantilevered length amounting to more than 800 mm. Moreover, these chucks have been successfully adapted for thread velocities of up to about 6000 m/min and for the reception of up to 8 spools with a total weight of about 120 kg.

A further increase in the usable length of the clutch can be achieved by providing a retractable holding means to support the chuck on its front projecting end during the winding operation, for example, a rotatably borne chuck member such as a friction cone or the like to hold the chuck spindle at its face end and turn coaxially therewith. The holding means is arranged on a pivot arm for movement between a rest position and the operating position aligned with the face end of the chuck spindle, i.e. so as to swing or swivel about a pivot or swivel axis which is preferably located on a base member of the housing. The holding means is preferably made with damping properties in order to damp vibratory movements of the projecting end of the chuck. Such damping can be effectively provided by a radially elastic or resilient bearing to support the rotatable clutch member. In its rest position, the holding means does not interfere with the ejection of the wound spools from the chuck.

The housing of the winding unit is particularly characterized by a longitudinal housing portion with an essentially longitudinal wall member which stands on an approximately vertical plane parallel to the guide plane and the common vertical plane of the chuck and holding means. This longitudinal portion is preferably joined with a rear housing part or primary housing. The primary housing serves especially to enclose the rear or primary bearing for the rotatable chuck as well as being a place to mount a brake means for the chuck. The primary housing and the longitudinal wall member form with one another an L-shaped horizontal cross section. It is also advantageous to provide the housing with a base plate in order to rigidify and strengthen the housing of the winding unit and to provide a means for mounting various working parts in a permanent position. This base plate together with the longitudinal member and the primary housing form the corner of a block, i.e. the three wall segments of these members are perpendicular to one another so as to form a block-like corner for the reception of the chuck, guide members and ejector. The base plate is especially adapted to provide a place to mount the swivel axis for the swivel arm of the holding means, this swivel axis being ideally arranged exactly perpendicularly beneath and parallel to the chuck axis, thereby permitting a good support of the chuck during the winding operation.

THE DRAWINGS

The invention is further described below with reference to the accompanying drawing wherein.

Figure 1:
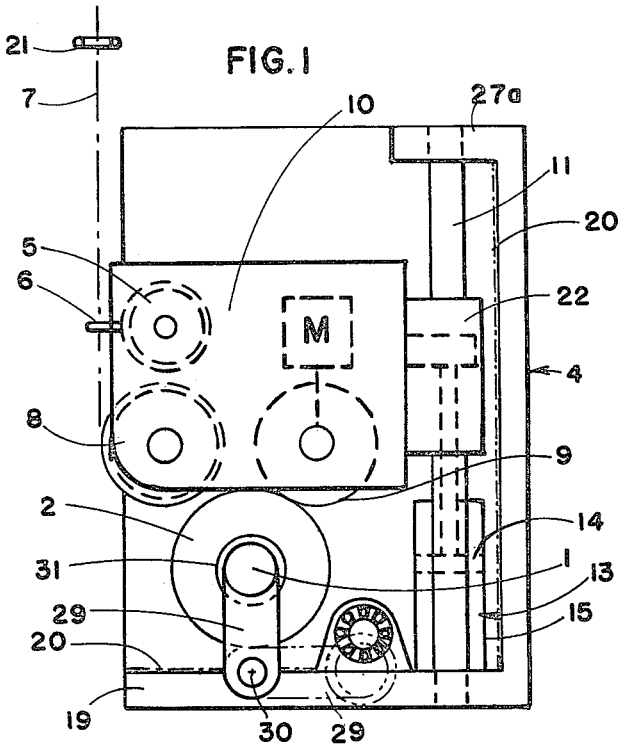
FIG. 1 is a partly schematic end view of a winding unit according to the invention.
Figure 2:
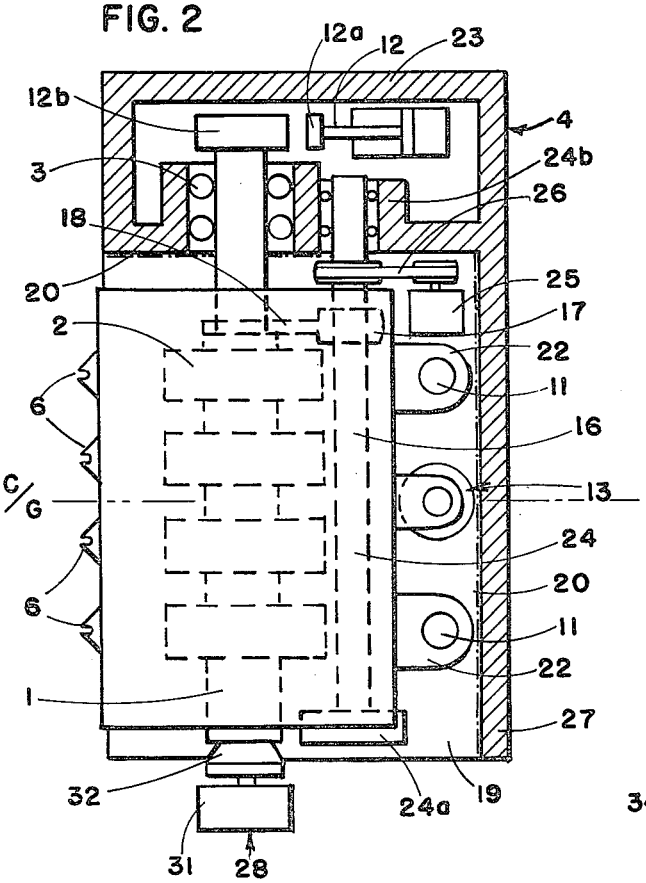
FIG. 2 is a partly schematic top plan view of the winding unit shown in FIG. 1, some portions being shown in a horizontal cross section.

Referring first to FIGS. 1 and 2, the chuck 1 carrying spools 2 clamped or gripped securely thereon is mounted for free rotation in the bearing 3 of the housing 4. The spools 2 are driven at a constant peripheral velocity by the rotatably driven contact roller 9 which runs in direct frictional contact on the circumference of each spool. In this manner, the thread 7 runs onto each spool at a constant speed and is wound into a spool package, including an inner sleeve or relatively thin-walled tube which slips onto the chuck spindle and is gripped by the chuck in a conventional manner. The motor M is used in this case to directly drive the roller 9 and is mounted within the slide carriage 10 together with this roller 9 and the traversing means.

The traversing means illustrated in FIGS. 1 and 2 includes a set of traversing thread guides 6, which are reciprocated by the reverse threaded shaft 5 rotatably mounted parallel to the chuck axis, and also includes the grooved roller 8 rotatably mounted parallel to the chuck axis. All of these traversing elements and their associated drive motors, if required, and the drive roller 9 with its motor M are carried in the slide carriage 10. The slide carriage 10 as a single assembly is movable along a plane substantially parallel to the plane described by the traversing path of the thread 7 as it runs between the fixed thread guide 21 and the traversing thread guide 6. The maximum deviation of the direction of movement from this plane amounts to 10°.

The slide carriage 10 is guided by the two guide rods, shafts or posts 11 on which the elongated slide members 22 move. For the bearing, one may use a slide bearing as shown or ball bearing guides of known construction. Two guide rods 11 are provided for the bearing in the embodiment described here but one may obviously use three or more of these guide members. It is an essential feature according to the invention to arrange the guide rods 11 on the side of the slide carriage 10 which faces away from the thread running plane, i.e. on the side away from where thread guide 21 and the traversing thread guides 6 are located.

In the plane of the carriage guides 11 (the guide plane), there is also positioned the counterbalancing means 13, which is shown in FIGS. 1 and 2 as pneumatic or hydraulic piston-cylinder means with the piston 14 being actuated in cylinder 15 by a pressure sufficient to partly or completely compensate for the total weight of the slide carriage assembly. The counterbalancing means is preferably arranged in the plane which is normal to the chuck axis and which also contains the center of gravity (C/G) of the slide carriage 10.

Figure 3:
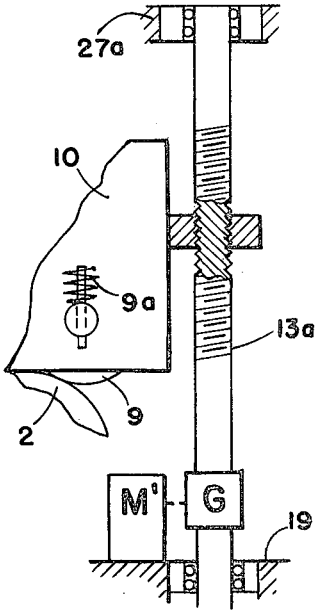
FIG. 3 is a schematic partial side view taken from FIG. 1 to illustrate an alternative counterbalancing member.
Figure 4:
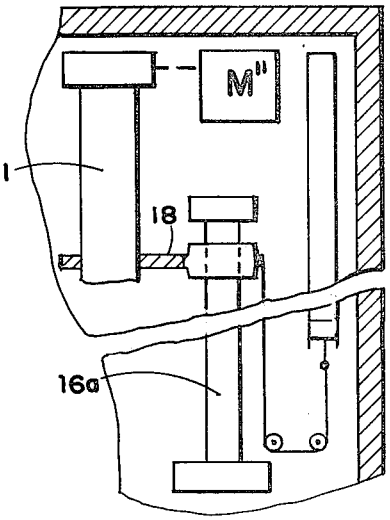
FIG. 4 is a schematic partial top plan view taken from FIG. 2 to illustrate a motor driven chuck.

As shown in FIG. 3, the counterbalancing means can be constructed as a rotatable threaded shaft 13*a* mounted in ball bearings located in the upper wall member 27*a* and base 19, respectively, and driven by motor M' over gear box G. This threaded shaft 13*a* thus replaces piston-cylinder unit 13 of FIGS. 1 and 2 to yield an effective counterbalancing member. The carriage 10 rides upwardly on the threaded portion of shaft 11*a* to match the increasing diameter of the spool 2 being wound. In this case, the contact roller 9 is resiliently urged against the circumference of the spool 2 by a constant pressure exerted by the preset spring 9*a*, preferably with the chuck 1 being directly driven by motor M" as indicated in FIG. 4. It will be understood in FIG. 3 that two or more guide members 11 are also mounted in the same guide plane as shaft 13*a* to provide the desired guide means for the carriage 10.

Parallel to the guide plane, there is arranged the ejector or so-called push-out device 16. As shown in FIGS. 1 and 2, this ejector includes a rotatable threaded spindle 24 which is mounted in the front and rear bearings 24*a* and 24*b* and driven by motor 25 over belt drive 26. The nut 17 with push-out arm 18 moves forwardly and backwardly along the threaded spindle 24 depending on the direction of rotation of the motor 25. The arm 18 on the threaded spindle engages behind the spools 2, i.e. so as to be in contact with the sleeves on which the spools 2 are wound, and after conclusion of the winding operation, this arm pushes the entire set of spools 2 forwardly in axial direction, preferably so as to be ejected from the chuck. As shown in FIG. 4, a piston-cylinder and rope-pulley arrangement may also be used to pull arm 18 forwardly along a guide rail 16*a*. The spools are collected by the operating personnel, preferably being slipped off onto a storage spindle.

The machine frame, viewed as a vertical cross section of the winding unit, comprises a base plate 19 and the longitudinal wall member 27, sometimes referred to in this specification as the longitudinal housing. It will be noted from FIG. 1 that this wall member 27 has a horizontal flange 27*a* which extends as a top member over the guide plane of the winding unit to provide an upper support for the guide members 11. Such variations in structure are desirable within the scope of this invention to provide suitable mounts, bearings or the like.

Preferably the housing also includes a rear casing 23, identified herein as the primary housing. This casing or primary housing 23 is especially useful for enclosing the main (rear) chuck bearing 3 as well as for accommodating the chuck brake 12, which is shown as a piston-cylinder unit with brake shoe 12*a* engaging the circumference of the rear end brake wheel 12*b* of the chuck 1. The base plate, longitudinal housing and primary housing are either cast from one piece or else bolted tightly together to provide a low-vibration, torsion-resistant housing unit.

The chuck 1 is supported on its front end by a rotatable holding device 31 which is in the form of a clutch member 32 located on a swivel arm, acting to provide a fixed pivotal support for the rotating chuck. The holder 31 in this case has a cone 32 which is borne on a shaft freely rotatable on its axis at the outer end of the swivel arm 29. The free end of the chuck 1 has a corresponding counter-cone to receive the cone 32 pressed inwardly in the direction of the arrow 28. The holder 31, as shown in FIG. 1 has a swinging or swivel movement about the axis 30 as well as the axial movement 28.

Figure 5:
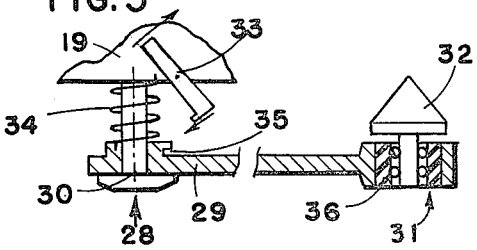
FIG. 5 is another schematic partial top plan view taken from FIG. 2 to illustrate in detail the retracted position of a swivel arm having a resiliently mounted cone member.

In order to disengage the clutch 31, a locking lever 33 is moved to its release position shown in FIG. 5 so that compressed spring 34 pushes arm 29 outwardly and at the same time acts as a torsion spring to swivel arm 29 into its retracted position, represented by phantom lines in FIG. 1. The reverse movements are carried out against the spring 34 to place the swivel arm 29 and rotatable cone member 32 into the operating position of FIG. 2. Locking lever 33 then moves in the direction of the two arrows as indicated to be inserted under the locking lip 35 on the swivel arm 29. The retracting and engaging movements of the holder 31 can be carried out by hand, but are preferably done by auxiliary unloading and loading equipment designed to carry out the necessary sequential motions. The corresponding drive means for such auxiliary equipment are not represented, since this subject matter is outside the scope of the invention and this auxiliary equipment can be readily adapted to the particular construction of the winding unit.

In operation, the cone 32 is maintained securely in its pivot position on the arm 29, and is resiliently pressed in the axial direction 28 against the free end of the chuck, this pressure being relatively constant during the winding operation. The holding cone 32 is preferably borne is elastic radial bearings 36 with good damping properties and supported resiliently in radial direction against the holding arm 29.

In order to reduce the propagation of noise, the longitudinal housing 27, the primary housing 23 and the base plate 19 are provided with a sound-absorbing and sound deadening covering 20, shown schematically in FIGS. 1 and 2.

Instead of using the motor-driven contact roller to drive the chuck over the sleeves and spools mounted thereon, the chuck 1 can also be driven directly by a motor M" as shown in FIG. 4, with braking means as part of the motor itself. In this case, the contact roller 9 is preferably adapted to measure and control or regulate the peripheral velocity of the spool, using conventional automatic control means.

The counterbalancing device can be directed against the carriage weight with a constant, predetermined force or pressure. It is also possible to regulate the counterbalancing force, as proposed for example in U.S. Pat. No. 4,106,710, based in part upon German patent specification (DE-OS) 25 44 773.

The invention is hereby claimed as follows:

1. In a winding unit of a spinning machine for taking up a plurality of spun synthetic fiber threads featuring a chuck to removably hold a plurality of spool sleeves on which said threads are wound with a traversing movement in a thread running plane, said chuck being rotatably mounted during the spool winding in a fixed axial position to project perpendicularly from a face of the machine, a contact roller arranged during said winding for rolling contact on the circumference of the sleeve or spool to control the peripheral speed of the spool being wound, a slide carriage which carries said contact roller and a traversing device assembled thereon in positions oriented parallel to the chuck axis with the thread running plane on one side of said carriage, traversing thread guide means on said traversing device projecting from the slide carriage and cantilevered into the thread running plane, means to support said slide carriage for vertically guided movement along a plane substantially parallel to said thread running plane such that said contact roller, being in circumferential contact with the sleeve or spool, will yield to the growing spool diameter during the winding, the improvement wherein:

said support means for said slide carriage include guide members on the side of the slide carriage away from the thread running plane and in a plane substantially parallel to the thread running plane to guide movement of the slide carriage, said guide members being mounted outside of the largest radius of the wound spools; and counterbalancing means acting on said slide carriage so as to partly or completely compensate for the weight of the entire carriage assembly.

2. A winding unit as claimed in claim 1 wherein said counterbalancing means is arranged substantially in a plane which is normal to the chuck axis and which contains the center of gravity of the slide carriage.

3. A winding unit as claimed in claim 1 wherein said counterbalancing means includes a piston-cylinder unit which acts to exert a pressure against the weight of the slide carriage.

4. A winding unit as claimed in claim 1 wherein said counterbalancing means is motor-driven threaded spindle, the slide carriage being supported on the thread of the spindle and the contact roller being resiliently supported with respect to the slide carriage.

5. A winding unit as claimed in claim 1 wherein said carriage guide members, as viewed axially of the slide carriage, provide support on both sides of a plane which is normal to the chuck axis and which contains the center of gravity of the slide carriage, and wherein said carriage guide members are located substantially symmetrically to said normal plane.

6. A winding unit as claimed in claim 1 including an ejector means which has a displaceable push-out arm movable parallel to the chuck axis, engaging behind the first sleeve or spool on the machine side, and which is supported by actuating means running parallel to the chuck axis.

7. A winding unit as claimed in claim 6 wherein said actuating means includes a threaded shaft with a nut movable thereon to carry the push-out arm.

8. A winding unit as claimed in claim 6 wherein said actuating means includes a piston-cylinder unit having its piston connected to a rope guided parallel to the chuck axis, said rope in turn being fastened to the push-out arm so as to pull the arm forwardly toward the outer end of the chuck for ejecting the wound spools.

9. A winding unit as claimed in claim 1 wherein the carriage guide members and the counterbalancing means are placed along a longitudinal housing member projecting substantially perpendicularly from the machine face.

10. A winding unit as claimed in claim 9 wherein the longitudinal housing member is constructed at least in part of a sound-absorbing material.

11. A winding unit as claimed in claim 1 wherein the projecting length of the chuck on which the spool sleeves are held is more than 800 mm.

12. A winding unit as claimed in claim 11 wherein the chuck is sufficiently long to receive more than two spool sleeves.

13. A winding unit as claimed in claim 1 including a retractable holding means to support the chuck on its front projecting end during the winding operation, said holding means being movable between an operating position aligned with the chuck axis and a rest position located outside the range of movement of the fully wound spools during their removal from the chuck.

14. A winding unit as claimed in claim 13 wherein said holding means is axially movable in its operating position.

15. A winding unit as claimed in claim 14 wherein said holding means is fastened to a swivel arm which is pivotable about a swivel axis.

16. A winding unit as claimed in claim 15 including a base plate member which contains said swivel axis in a position located substantially perpendicularly beneath and parallel to the chuck axis for pivotal rotation of the swivel arm.

17. A winding unit as claimed in claim 9 wherein the housing of the winding unit includes said longitudinal member and a base plate member which together form a right angle with each other in a vertical cross section of the winding unit.

18. A winding unit as claimed in claim 9 wherein said longitudinal member is connected with a vertical primary housing in such a way that the longitudinal housing member and the primary housing form an L-shaped horizontal cross section.

19. A winding unit as claimed in claim 18 wherein the housing consists essentially of said longitudinal member, a base plate member, and a primary housing which are arranged in the form of three block sides meeting in a corner.

20. A winding unit as claimed in claim 19 wherein the chuck is borne in the primary housing and projects therefrom in a cantilevered position with its axis extending substantially parallel to said longitudinal member and said base member.

* * * * *